US007194227B2

(12) United States Patent
Yu

(10) Patent No.: US 7,194,227 B2
(45) Date of Patent: Mar. 20, 2007

(54) IMAGING MEMBER BELT SUPPORT MODULE

(75) Inventor: Robert C. U. Yu, Webster, NY (US)

(73) Assignee: Xerox Corporation, Stamford, CT (US)

( * ) Notice: Subject to any disclaimer, the term of this patent is extended or adjusted under 35 U.S.C. 154(b) by 134 days.

(21) Appl. No.: 10/915,063

(22) Filed: Aug. 10, 2004

(65) Prior Publication Data

US 2006/0034634 A1 Feb. 16, 2006

(51) Int. Cl.
*G03G 15/00* (2006.01)

(52) U.S. Cl. ..... 399/165

(58) Field of Classification Search ..... 399/159, 399/162, 165, 302, 308; 198/837, 840
See application file for complete search history.

(56) References Cited

U.S. PATENT DOCUMENTS

| | | | | |
|---|---|---|---|---|
| 3,121,006 | A | 2/1964 | Middleton et al. | |
| 3,442,781 | A | 5/1969 | Weinberger | |
| 3,870,516 | A | 3/1975 | Smith et al. | |
| 3,972,717 | A | 8/1976 | Wiedemann | |
| 3,984,183 | A * | 10/1976 | Maksymiak | 399/313 |
| 4,061,222 | A | 12/1977 | Rushing | |
| 4,174,171 | A | 11/1979 | Hamaker et al. | |
| 4,233,384 | A | 11/1980 | Turner et al. | |
| 4,265,990 | A | 5/1981 | Stolka et al. | |
| 4,286,033 | A | 8/1981 | Neyhart et al. | |
| 4,291,110 | A | 9/1981 | Lee | |
| 4,299,897 | A | 11/1981 | Stolka et al. | |
| 4,302,521 | A | 11/1981 | Takei et al. | |
| 4,306,008 | A | 12/1981 | Pai et al. | |
| 4,338,387 | A | 7/1982 | Hewitt | |
| 4,344,693 | A | 8/1982 | Hamaker | |
| 4,415,639 | A | 11/1983 | Horgan | |
| 4,439,507 | A | 3/1984 | Pan et al. | |
| 4,566,162 | A * | 1/1986 | Brands | 26/105 |
| 4,786,570 | A | 11/1988 | Yu et al. | |
| 4,801,517 | A | 1/1989 | Frechet et al. | |
| 4,806,443 | A | 2/1989 | Yanus et al. | |
| 4,806,444 | A | 2/1989 | Yanus et al. | |
| 4,818,650 | A | 4/1989 | Limburg et al. | |
| 4,832,186 | A * | 5/1989 | Conrad | 198/840 |
| 4,937,117 | A | 6/1990 | Yu | |
| 4,961,089 | A | 10/1990 | Jamzadeh | |
| 5,021,309 | A | 6/1991 | Yu | |
| 5,030,532 | A | 7/1991 | Limburg et al. | |
| 5,078,263 | A | 1/1992 | Thompson et al. | |
| 5,606,396 | A | 2/1997 | Yu et al. | |
| 2005/0078988 | A1* | 4/2005 | Matsui et al. | 399/302 |
| 2006/0147230 | A1* | 7/2006 | Park et al. | 399/302 |

FOREIGN PATENT DOCUMENTS

| | | |
|---|---|---|
| JP | 11-52759 | * 2/1999 |
| JP | 11-282262 | * 10/1999 |
| JP | 2002-182494 | * 6/2002 |
| JP | 2005-77669 | * 3/2005 |

* cited by examiner

*Primary Examiner*—Hoan Tran
(74) *Attorney, Agent, or Firm*—Eugene O. Palazzo; Fay Sharpe LLP

(57) ABSTRACT

Disclosed are various embodiments of a belt support module design for use in an imaging forming apparatus or machine. The belt support module is utilized in association with an electrostatographic imaging belt. The belt support module has at least one flexible spreader roller to suppress, or effect the elimination of, belt ripple or wrinkle development during machine belt cycling operation.

19 Claims, 8 Drawing Sheets

FIG. 4A
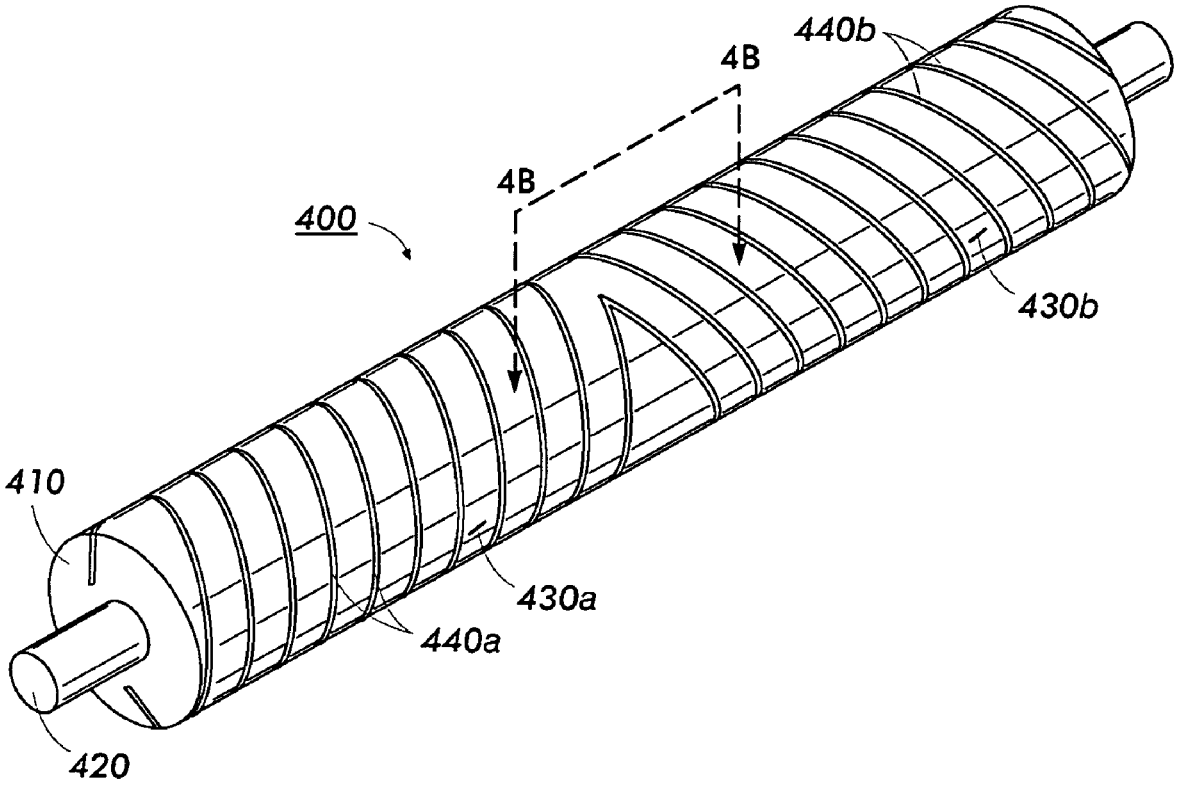
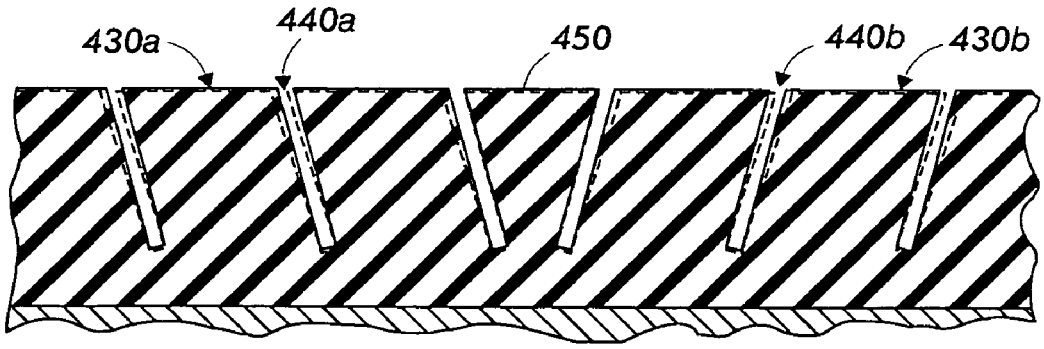
FIG. 4B

FIG. 6A
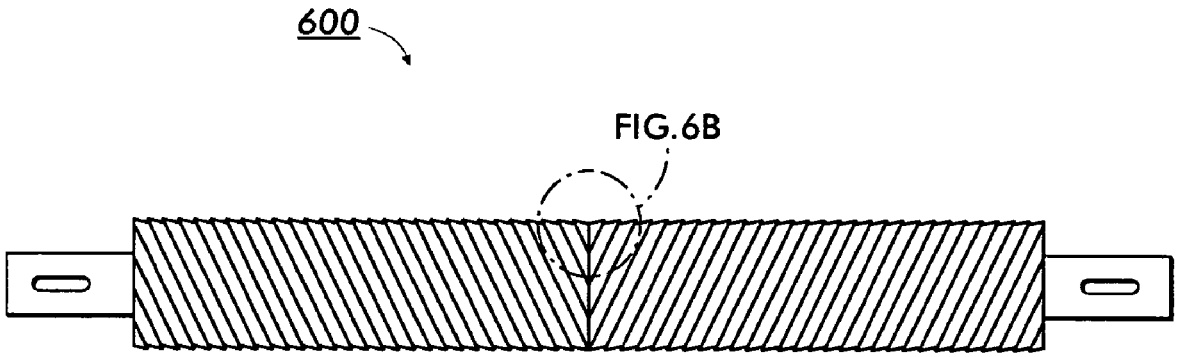
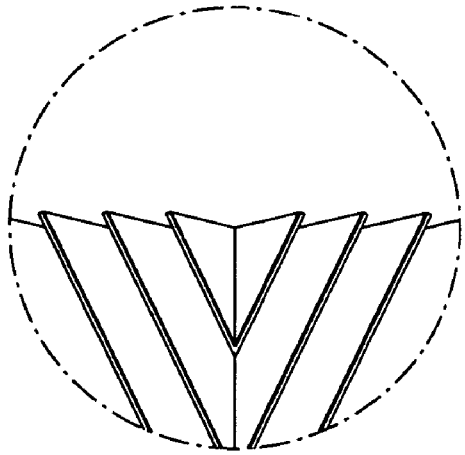
FIG. 6B

FIG. 7A
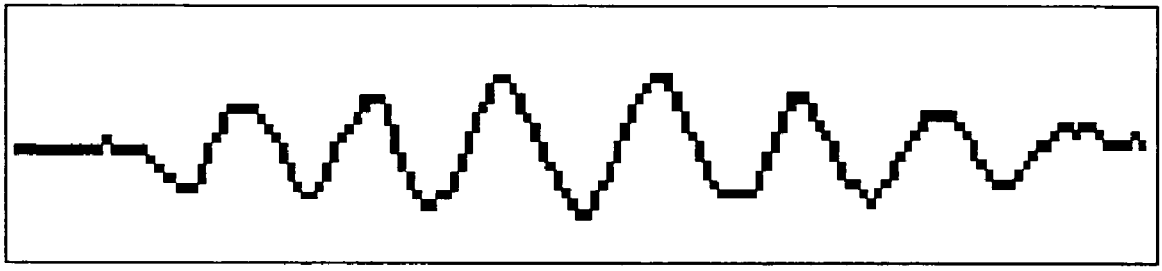
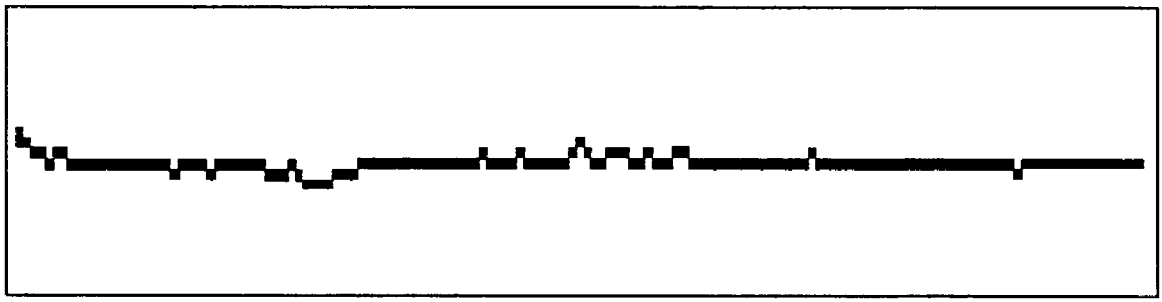
FIG. 7B

IMAGING MEMBER BELT SUPPORT MODULE

BACKGROUND

This disclosure relates in general to various embodiments of a belt support module and more specifically, to a flexible electrostatographic imaging member belt support module which reduces and/or suppresses belt rippling effects.

Flexible electrostatographic belt imaging members are well known in the art. Typical electrostatographic flexible belt imaging members include, for example, photoreceptors for electrophotographic imaging systems; electroreceptors or flexible ionographic imaging members for electrographic imaging systems; and flexible intermediate transfer belts for transferring toner images in electrophotographic and electrographic imaging systems.

The flexible electrostatographic imaging members can be in the form of seamless or seamed belts or webs. Conventional flexible electrophotographic imaging member belts comprise a charge transport layer and a charge generating layer on one side of a supporting substrate layer and an anti-curl back coating applied to the opposite side of the supporting substrate layer to render flatness. Electrographic imaging member belts, however, may typically have a simpler material structure, including a dielectric imaging layer on one side of a supporting substrate and an anti-curl back coating on the opposite side of the substrate.

Additionally, flexible intermediate transfer belts are generally single layer semi-conductive substrate belts. The belts have a specific electrical conductivity to effect toner image transferring from photoreceptor surface onto the intermediate transfer belt.

Typical electrostatographic imaging member belts are seamed flexible belts. They are belts usually formed by cutting a rectangular sheet out from a production web stock, overlapping the two opposite ends, and joining the overlapped ends together to form a seamed belt. The fabricated seamed flexible belt is then mounted over and encircled a machine belt support module consisting of a plurality of belt support rollers of different diameters for use in an electrostatographic imaging machine.

While the scope of the embodiments of the present disclosure covers an improved belt support module design for enhancing flexible electrostatographic imaging member belt machine function, the following discussion will herein after focus, for reason of simplicity, only on flexible electrophotographic imaging member seamed belts preparation and their machine function as representation of the overall development.

Flexible electrophotographic imaging member belts can be multilayered photoreceptors used for a negatively charged electrophotographic imaging system. In such a system, the belts can comprise a substrate, an electrically conductive layer, an optional hole blocking layer, an adhesive layer, a charge generating layer, a charge transport layer, and an anti-curl backing layer. One type of multilayered photoreceptor belt comprises a layer of finely divided particles of a photoconductive inorganic compound dispersed in an electrically insulating organic resin binder. For example, U.S. Pat. No. 4,265,990, incorporated herein by reference in its entirety, discloses a layered photoreceptor having separate charge generating (photogenerating) and charge transport layers. The charge generating layer is capable of photogenerating electron-hole pairs and injecting the photogenerated holes into the charge transport layer.

The electrophotographic imaging members in the aforementioned system usually require an anti-curl back coating, applied to the back side of the supporting substrate opposite the electrically operative layers, for counteracting and balancing the curl to render imaging member flatness. This is because without the application of an anti-curl back coating, a flexible imaging member sheet, for example, about 16 inches (40.64 centimeters) in width by about 48 inches (121.9 centimeters) in length, will curl somewhat spontaneously upwardly into an about 1½ inch (38.1 millimeters) diameter roll. Although the application of the anti-curl back coating is solely for the mechanical purpose of maintaining the imaging member flatness, nonetheless the need of the anti-curl back coating will cause a substantial internal tensile strain (or stress) build-up in the charge transport layer as a consequence of counter-acting the upward curling effect.

After application of the anti-curl back coating, the prepared production electrophotographic imaging member web stock is then cut to give rectangular or parallelogram shape sheets of precisely predetermined dimensions. The opposite ends of each cut imaging member sheet are brought together to produce an overlap, such as a 1.0 mm overlap. This is followed by application of a joinder process, such as an ultrasonic welding process, along the overlapped region to form a seamed imaging member belt. The seamed imaging member belt is then mounted over and encircles a machine belt support module ready for electrophotographic imaging processes.

Although excellent toner images may be obtained with multilayered belt photoreceptors, it has however been found that as more advanced, higher speed electrophotographic copiers, duplicators and printers were developed, the premature onset of the formation of photoreceptor belt ripples or wrinkles along the longitudinal belt direction can occur. This is after, in some instances, a just few hundreds dynamic belt cyclic revolution around the belt support module during machine imaging function.

In this regard, it has been found during operation, that fatigue induced centric belt compression can be created by the dynamic imaging member belt cyclic motion. When the belt is cycled around the rollers during operation, compressive forces in the cross-web direction are generated. These forces cause compression from both of the parallel longitudinal edges of the belt directed toward the longitudinal center. This triggers the formation of fatigue induced wrinkles or ripples in the belt.

In a cross section viewing transversely at the photoreceptor belt, the above noted ripples resemble a sine wave having an average amplitude of about 7 micrometers with a frequency of periodicity of about 6 ripples per inch belt width, and appear to the naked eye as series of fine rings extending around the circumference of a typical photoreceptor belt. The formation of wave like topology of these ripples in the photoreceptor belt has been found to alter the distance (or gap) between the photoreceptor belt surface and the machine charging device(s). Consequently, the ripples impact charge density evenness on the belt surface.

Moreover, the wavelike topology of belt ripples prevents intimate and uniform contact between a receiving copy sheet and toner images carried on the surface of the photoreceptor belt during toner image transfer step to also adversely affect the toner transferring efficiency and thereby impact the quality of the final print. Since belt ripples in the photoreceptor belt developed as a result of dynamic belt motion do manifest themselves into print defects in the final copy print-outs, their appearance impacts the copy quality and thereby shortens the photoreceptor belt service life.

There is also a great need for long service life flexible belt photoreceptors in compact imaging machines that employ small diameter support rollers for photoreceptor belt systems operating in a very confined space. Small diameter support rollers are also highly desirable for simple, reliable copy paper stripping systems which utilize the beam strength of the copy paper to automatically remove copy paper sheets from the surface of photoreceptor belts after toner image transfer. Unfortunately, small diameter rollers, e.g. less than about 0.75 inch (19 mm) diameter, raise the threshold of mechanical performance criteria to such a high level that early emergence of photoreceptor belt ripples, exacerbated by the larger induced bending strain in the belt over this small diameter roller, can become unacceptable. This may negate the benefit that is realized by employing a small belt module support roller to provide the paper copy self stripping result.

Furthermore, when cycled in an electrophotographic imaging system employing a complex belt support design having an active steering roll to control belt walk, the internal strain generated within the photoreceptor layers by the dynamic belt revolution is aggravated by the belt shear stress as a result of the steering action by the active roll. This steering action has been found to be the cause that leads to spontaneous development of ripples in the photoreceptor belt even for a belt mounted over a belt support module without utilizing a small 19 mm diameter roller.

In addition to the ripples manifestation into copy print-out defects, the belt ripples have also been found to prevent the toner cleaning blade for making intimate physical contact with the belt surface to thereby significantly reduce the efficiency of the blade's cleaning function. This, in turn, is detrimental to the creation of high quality images in the final print copy. Moreover, belt ripples do also seem to prevent intimate cleaning contact with the photoreceptor belt surface for efficient cleaning.

Although the foregoing discussions are focused only in terms of dynamic mechanical interaction between an electrophotographic imaging belt and a belt support module leading to the development of belt ripples and cleaning issues, nevertheless the problems described and their respective solution are equally applicable to the electrographic imaging belts as well as the intermediate transfer belts.

REFERENCES

U.S. Pat. No. 5,606,396 to Yu et al., issued Feb. 25, 1997, and incorporated herein by reference in its entirety—An electrostatographic imaging process is disclosed which includes providing a flexible electrostatographic, particularly electrophotographic, imaging belt including a substrate layer, a charge generating layer, charge transport layer, and two parallel longitudinal edges, the imaging belt having a charge transport layer tension strain of less than about 0.05 percent across the width of the belt, mounting the imaging belt on a plurality of spaced apart support rollers, transporting the belt around the support rollers, repeatedly applying a cross belt compression strain distributed in an arcuate gradient of increasing intensity from the longitudinal centerline of the belt to each of the edges of the belt, the strain applied at each of the edges of the belt repeatedly peaking to an intensity at the longitudinal edges of at least about 0.6 percent greater than the strain applied to the centerline of the belt, forming an electrostatic latent image on the belt, developing the electrostatic latent image with toner to form a toner image corresponding to the latent image, transferring the toner image to a receiving member, and repeating the forming, developing and transferring steps at least once. The flexible electrostatographic imaging belt may be fabricated without an anti-curl layer in a continuous process.

U.S. Pat. No. 4,961,089 to Jamzadeh, issued Oct. 2, 1990—Web tracking apparatus and methods are disclosed having particular utility in electrostatographic reproduction apparatus. A web includes a plurality of image frames allowing images to be written thereon and transferred therefrom to a receiver. A guide means moves such web along a path and includes a steering roller mounted for rotation about a caster axis and a gimbal axis. A web tracking system for controlling the guide means to effect lateral alignment of said web is provided such that the deviation of corresponding points of transferred images is minimized. Degradation of image registration due to mid-print corrections is eliminated and steering corrections are made less frequent by the use of adaptive and predictive algorithms. The writing and transfer of images is thereby accomplished in accurate registration and is particularly well-suited for use in forming accurate multicolor reproduction of superimposed images.

U.S. Pat. No. 5,078,263 to Thompson et al., issued Jan. 7, 1992 —A web-steering mechanism is disclosed, particularly for the endless belt of a xerographic copier, uses two rolls to hold the belt under tension. An idler roll is designed to rotate about an axis which is at a small angle to a tilt axis of the idler roll assembly. Small tilting movements of the idler roll assembly, under the control of a servo-motor are effective to alter the angle at which the web enters and/or leaves the roll, to cause the web to walk along the tilted roll.

U.S. Pat. No. 4,174,171 to Hamaker et al., issued Nov. 13, 1979—An apparatus is disclosed in which the lateral alignment of a belt arranged to move in a pre-determined path is controlled. A support mounted resiliently constrains lateral movement of the belt causing the belt to apply a moment to a pivotably mounted steering post. As a result of this moment, the steering post pivots in a direction to restore the belt to the pre-determined path.

U.S. Pat. No. 4,344,693 to Hamaker, issued Aug. 17, 1982—An apparatus is disclosed which controls the lateral alignment of a belt arranged to move in a pre-determined path. A pivotably mounted belt support is frictionally driven to move in unison with the belt. Lateral movement of the belt applies a frictional force on the belt support. The frictional force tilts the belt support in a direction so as to restore the belt to the predetermined path of movement.

U.S. Pat. No. 4,061,222 to Rushing, issued Dec. 6,1977—Apparatus is disclosed for automatically tracking an endless belt or web of material in a stable, predetermined path of movement despite changes in the belt configuration due to differential belt stretching or the introduction into the machine of a new belt having a slightly different configuration. The apparatus includes a steering roller supported for rotational movement about the longitudinal central axis and tilting movement about an axis perpendicular to the longitudinal axis. In one embodiment, a steering roller control signal is produced by comparing the magnitude of the weighted sum of voltage signals representative of the lateral belt edge position and the tilted roller position with the magnitude of the integrated sum of the lateral belt edge position signal and a command signal representative of the desired lateral belt edge position. In a second embodiment, the steering roller control signal is produced by comparing the magnitude of the weighted sum of voltage signals representative of the lateral belt edge position and the instantaneous lateral belt deviation rate with the magnitude of the command signal representative of the desired lateral belt edge position.

Thus, there is a continuing need for electrostatographic imaging system utilizing flexible imaging member belts that are free of copy defect problems under a normal machine functioning condition, particularly, having the capability of suppression the development of belt ripples and their manifestation as defects in print-out copy.

BRIEF DESCRIPTION

The exemplary embodiments of the present disclosure provide an improved electrostatographic imaging system which overcomes one or more of the above-noted deficiencies.

In one embodiment, the disclosure relates to an enhanced belt support module design that produces robust dynamic mechanical cycling life function.

In another embodiment, the present disclosure provides an improved belt support module design that results in enhanced electrostatographic imaging member belt cyclic imaging and cleaning processes.

In a further embodiment, the disclosure concerns an improved belt support module design that enables electrostatographic imaging belt robust dynamic cyclic imaging function substantially free of belt ripple development.

In another embodiment, the present disclosure provides a belt support module design having an electrostatographic imaging belt which produces extensive image cycling life enhancement without copy print-out defects produced by belt ripple development.

In still another embodiment, the disclosure relates to a belt support module employing a belt spreader roller designed to suppress belt ripple development as the electrostatographic imaging belt revolves around and flexes over each belt module support rollers.

In a further embodiment, the disclosure concerns an electrostatographic imaging system and process comprising providing a flexible electrostatographic, particularly electrophotographic, imaging member belt comprising a substrate layer, a charge generating layer, charge transport layer, and an anti-curl back coating, mounting the imaging member belt on an improved belt module design comprising one or more spaced apart support rollers, an optional steering roller, and a flexible spreader roller. Therefore, as the belt is transporting around all the rollers, the flexible spreader roller will spontaneously create a cross belt tension to effectively counteract and offset the compression strain generated by belt rotations in dynamic motion. This provides belt ripple suppression or total elimination of the problem. The process further comprises forming an electrostatic latent image on the belt surface, developing the electrostatic latent image with toner to form a toner image corresponding to the latent image, transferring the toner image to a receiving paper copy, and repeating the forming, developing and transferring steps at least once to produce copy output which is free of defects associated with belt ripple development.

In a still further embodiment, the disclosure relates to providing a flexible imaging member belt of the above general. description, mounting the belt over and encircling a belt support module comprising multiple support rollers, in which one specific flexible spreader roller is employed, to suppress or absolutely prevent the development of dynamic motion induced belt ripples during machine imaging function.

These and other non-limiting aspects, features and/or objects of the present disclosure are more particularly disclosed below.

BRIEF DESCRIPTION OF THE DRAWINGS

The following is a brief description of the drawings, which are presented for the purposes of illustrating the development disclosed herein and not for the purposes of limiting the same.

FIG. 4A illustrates an embodiment of a selected flexible spreader roller of the present disclosure.

FIG. 4B is an enlarged view of a portion of the selected flexible spreader roller of FIG. 4A.

FIG. 6A illustrates a further embodiment of a selected flexible spreader roller.

FIG. 6B shows an amplified view of the middle section of the flexible spreader roller of FIG. 6A.

FIG. 7A illustrates the typical cross-sectional topology of belt ripples formed in a conventional imaging member belt after dynamic belt cyclic revolutions around a belt support module.

FIG. 7B shows the absence of the development of belt ripples in an imaging member belt after extended fatigue cycling revolutions over the same belt support module, except that one of the module supporting rollers is replaced with the flexible spreader roller of FIG. 4A.

It is important to point out that the like numeric designations of the figures and the descriptions above are referred to components of like function.

DETAILED DESCRIPTION OF EXEMPLARY EMBODIMENTS

The present disclosure relates to various embodiments of a belt support module for use in an imaging forming apparatus or machine. The belt support module is utilized in association with an electrostatographic imaging member belt functioned in a machine. The belt support module has at least one flexible spreader roller to suppress, or eliminate, belt ripple or wrinkle development during machine operation.

The flexible spreader roller is used in a belt support module, such as a bi- or tri-roller support module, or a multiple-roller belt support module, to spontaneously generate an outward transversal force. This force outwardly expands the belt in the cross web direction to counter-act the compression effect as the belt is dynamically cycled around the belt support module rollers during machine imaging operation and thereby eliminating the belt ripples problem.

In this regard, in operation, the flexible spreader roller generates a transverse belt expansion effect during belt cycling. This effect is utilized to offset the fatigue induced centric belt compression forces, thereby reducing and/or suppressing belt ripple development.

More particularly set forth below is a description of various electrostatographic imaging member belts, belt support modules and flexible spreader rollers that can be used in association with the various embodiments of the present disclosure.

The fabrication of multi-layered seamed imaging member belt using the conventional electrophotographic imaging member preparation procedures is described in detail below.

Figure 1:
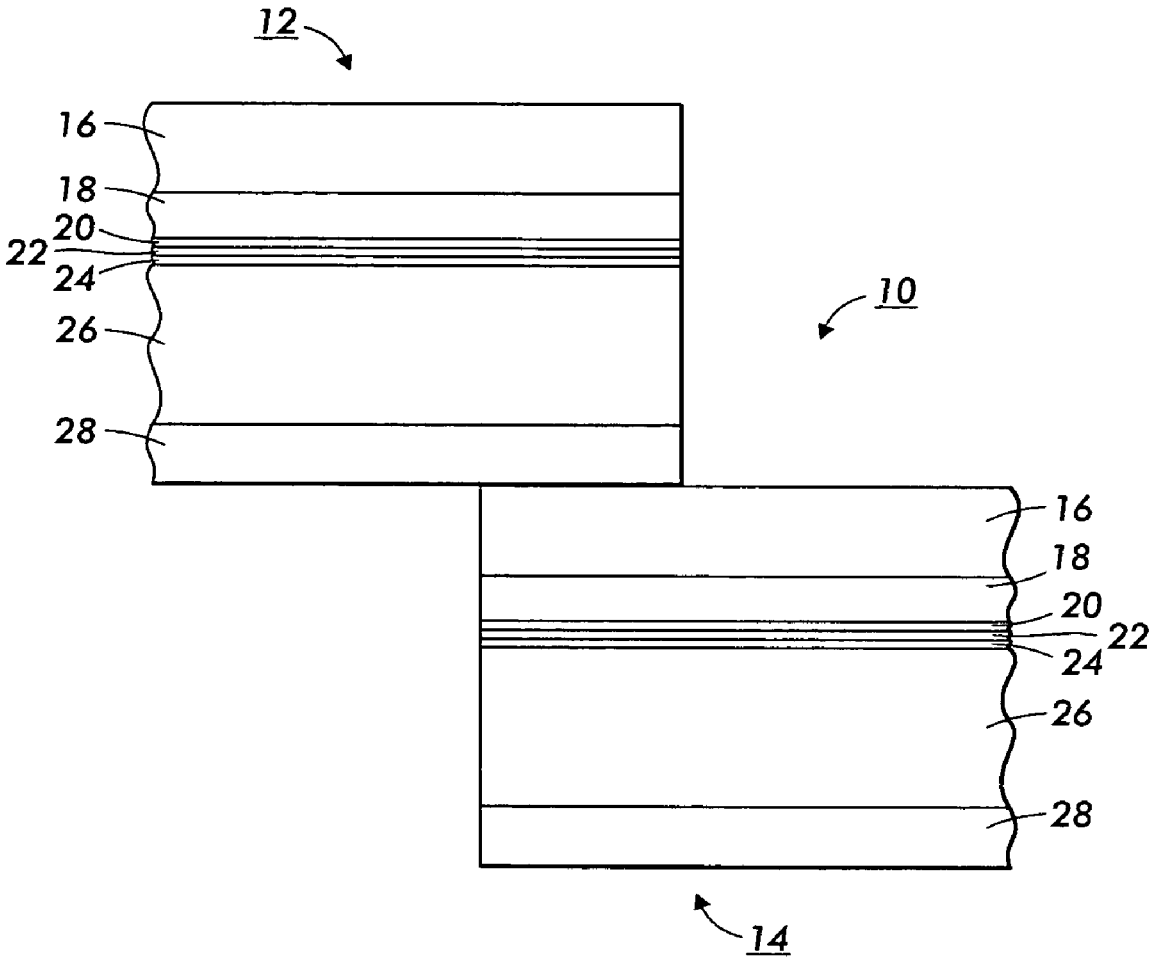
FIG. 1 is a cross sectional view of a flexible multiple layered electrophotographic imaging member showing overlapped opposite ends of a sheet.

A typical, negatively charged, multilayered electrophotographic imaging member of flexible web stock configuration is illustrated in FIG. 1. Generally, such a member includes a substrate support layer 26 on which a conductive layer 24, a hole blocking layer 22, a photogenerating layer 18, and an active charge transport layer 16 are formed. An optional adhesive layer 20 can be applied to the hole blocking layer 22 before the photogenerating layer 18 is deposited. Other layers, such as a grounding strip layer and an optional overcoat layer (not shown) can be applied to provide respective characteristics, such as for grounding contact and improve resistance to abrasion. On the opposite surface of substrate support 26, an anti-curl back coating 28 can be applied to reduce the curling induced by the different coefficients of thermal expansion of the various coating layers and render the imaging member flatness.

The substrate of a photoreceptor belt may be opaque or substantially transparent and may comprise numerous suitable materials having the required mechanical properties. Accordingly, the substrate may comprise a layer of an electrically non-conductive or conductive material such as an inorganic or an organic composition. As electrically non-conducting materials, there may be employed various resins known for this purpose including polyesters, polycarbonates, polyamides, polyurethanes, polysulfones, and the like which are flexible as thin webs. The electrically insulating or conductive substrate should be flexible and in the form of an endless flexible belt. Preferably, the endless flexible belt shaped substrate comprises a commercially available biaxially oriented polyester known as Mylar™, available from E. I. DuPont de Nemours & Co. or Melinex™ available from ICI Americas, Inc. or Hostaphan™, available from American Hoechst Corporation.

The thickness of the substrate layer 26 depends on numerous factors, including beam strength and economical considerations, and thus this layer for a flexible belt may be of substantial thickness, for example, about 175 micrometers, or of minimum thickness less than 50 micrometers, provided there are no adverse effects on the final electrostatographic device. In one flexible belt embodiment, the thickness of this layer is between about 65 micrometers and about 150 micrometers, and preferably between about 75 micrometers and about 100 micrometers for optimum flexibility and minimum stretch when cycled around small diameter rollers, e.g. 19 millimeter diameter rollers.

The conductive layer 24 may vary in thickness over substantially wide ranges depending on the optical transparency and degree of flexibility desired for the electrostatographic member. Accordingly, for a flexible photoresponsive imaging device, the thickness of the conductive layer may be between about 20 angstrom units to about 750 angstrom units, and more preferably from about 100 Angstrom units to about 200 angstrom units for an optimum combination of electrical conductivity, flexibility and light transmission. The flexible conductive layer may be an electrically conductive metal layer formed, for example, on the substrate by any suitable coating technique, such as a vacuum depositing technique. Typical metals include aluminum, zirconium, niobium, tantalum, vanadium and hafnium, titanium, nickel, stainless steel, chromium, tungsten, molybdenum, and the like. Regardless of the technique employed to form the metal layer, a thin layer of metal oxide forms on the outer surface of most metals upon exposure to air. Thus, when other layers overlying the metal layer are characterized as "contiguous" layers, it is intended that these overlying contiguous layers may, in fact, contact a thin metal oxide layer that has formed on the outer surface of the oxidizable metal layer. Generally, for rear erase exposure, a conductive layer light transparency of at least about 15 percent is desirable. The conductive layer need not be limited to metals. Other examples of conductive layers may be combinations of materials such as conductive indium tin oxide as a transparent layer for light having a wavelength between about 4000 Angstroms and about 7000 Angstroms or a transparent copper iodide (CuI) or a conductive carbon black dispersed in a thermoplastic film forming binder as an opaque conductive layer. A typical electrical conductivity for conductive layers for electrophotographic imaging members in slow speed copiers is about 102 to 103 ohms/square.

After formation of an electrically conductive surface, a charge blocking layer 22 may be applied thereto. Generally, electron blocking layers for positively charged photoreceptors allow holes from the imaging surface of the photoreceptor to migrate toward the conductive layer 24. Any suitable blocking layer capable of forming an electronic barrier to holes between the adjacent photoconductive layer and the underlying conductive layer may be utilized. The blocking layer may be nitrogen containing siloxanes or nitrogen containing titanium compounds as disclosed, for example, in U.S. Pat. Nos. 4,291,110, 4,338,387, 4,286,033 and 4,291,110, the disclosures of these patents being incorporated herein in their entirety. A preferred blocking layer comprises a reaction product between a hydrolyzed silane and the oxidized surface of a metal ground plane layer. The blocking layer may be applied by any suitable conventional technique such as spraying, dip coating, draw bar coating, gravure coating, silk screening, air knife coating, reverse roll coating, vacuum deposition, chemical treatment and the like. For convenience in obtaining thin layers, the blocking layers are preferably applied in the form of a dilute solution, with the solvent being removed after deposition of the coating by conventional techniques such as by vacuum, heating and the like. The blocking layer should be continuous and have a thickness of less than about 0.2 micrometer because greater thicknesses may lead to undesirably high residual voltage.

An adhesive layer 20 may applied over the hole blocking layer 22. Any suitable adhesive layer well known in the art may be utilized. Typical adhesive layer materials include, for example, polyesters such as Mor-Ester™ 49,000 (available from Morton International, Inc.) and Vitel™ PE100 (available from Goodyear Tire & Rubber), polyurethanes, and the like. Satisfactory results may be achieved with adhesive layer thickness between about 0.05 micrometer (500 angstroms) and about 0.3 micrometer (3,000 angstroms). Conventional techniques for applying an adhesive layer coating mixture to the charge blocking layer include spraying, dip coating, roll coating, wire wound rod coating, gravure coating, Bird applicator coating, and the like. Drying of the deposited coating may be effected by any suitable conventional technique such as oven drying, infra red radiation drying, air drying and the like.

Any suitable photogenerating layer 18 may be applied to the adhesive layer 20. Typical photogenerating layers include inorganic photoconductive particles such as amorphous selenium, trigonal selenium, and selenium alloys selected from the group consisting of selenium-tellurium, selenium-tellurium-arsenic, selenium arsenide and mixtures thereof, and organic photoconductive particles including various phthalocyanine pigments such as the X-form of metal free phthalocyanine, metal phthalocyanines such as vanadyl phthalocyanine and copper phthalocyanine, dibromoanthanthrone, squarylium, quinacridones available from DuPont under the tradename Monastral™ Red, Monastral™ violet and Monastral™ Red Y, Vat orange 1 and Vat orange 3 trade names for dibromo anthanthrone pigments, benzimidazole perylene, substituted 2,4-diamino-triazines disclosed in U.S. Pat. No. 3,442,781, polynuclear aromatic quinones available from Allied Chemical Corporation under the tradename Indofast™ Double Scarlet, Indofast™ Violet Lake B, Indofast™ Brilliant Scarlet and Indofast™ Orange, and the like dispersed in a film forming polymeric binder. Multi-photogenerating layer compositions may be utilized where a photoconductive layer enhances or reduces the properties of the photogenerating layer. Examples of this type of configuration are described in U.S. Pat. No. 4,415,639, the entire disclosure thereof being incorporated herein by reference. Other suitable photogenerating materials known in the art may also be utilized, if desired. Charge generating binder layers comprising particles or layers comprising a photoconductive material such as vanadyl phthalocyanine, metal free phthalocyanine, benzimidazole perylene, amorphous selenium, trigonal selenium, selenium alloys such as selenium-tellurium, selenium-tellurium-arsenic, selenium arsenide, and the like and mixtures thereof are especially preferred because of their sensitivity to white light. Vanadyl phthalocyanine, metal free phthalocyanine and tellurium alloys are also preferred because these materials provide the additional benefit of being sensitive to infrared light.

Any suitable polymeric film forming binder material may be employed as the matrix in the photogenerating binder layer. Typical polymeric film forming materials include those described, for example, in U.S. Pat. No. 3,121,006, the entire disclosure of which is incorporated herein by reference. Thus, typical organic polymeric film forming binders include thermoplastic and thermosetting resins such as polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl acetate, polysiloxanes, polyacrylates, polyvinyl acetals, polyamides, polyimides, amino resins, phenylene oxide resins, terephthalic acid resins, phenoxy resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly(amideimide), styrene-butadiene copolymers, vinylidenechloride-vinylchloride copolymers, vinylacetate-vinylidenechloride copolymers, styrene-alkyd resins, polyvinylcarbazole, and the like. These polymers may be block, random or alternating copolymers.

The photogenerating composition or pigment is present in the resinous binder composition in various amounts, generally, however, from about 5 percent by volume to about 90 percent by volume of the photogenerating pigment is dispersed in about 10 percent by volume to about 95 percent by volume of the resinous binder, and preferably from about 20 percent by volume to about 30 percent by volume of the photogenerating pigment is dispersed in about 70 percent by volume to about 80 percent by volume of the resinous binder composition. In one embodiment about 8 percent by volume of the photogenerating pigment is dispersed in about 92 percent by volume of the resinous binder composition.

The photogenerating layer containing photoconductive compositions and/or pigments and the resinous binder material generally ranges in thickness of from about 0.1 micrometer to about 5 micrometers, and preferably has a thickness of from about 0.3 micrometer to about 3 micrometers. The photogenerating layer thickness is related to binder content. Higher binder content compositions generally require thicker layers for photogeneration. Thicknesses outside these ranges can be selected providing the objectives of the present disclosure are achieved.

Any suitable and conventional technique may be utilized to mix and thereafter apply the photogenerating layer coating mixture. Typical application techniques include spraying, dip coating, roll coating, wire wound rod coating, and the like. Drying of the deposited coating may be effected by any suitable conventional technique such as oven drying, infra red radiation drying, air drying and the like.

The active charge transport layer 16 may comprise an activating compound useful as an additive dispersed in electrically inactive polymeric materials making these materials electrically active. These compounds may be added to polymeric materials which are incapable of supporting the injection of photogenerated holes from the generation material and incapable of allowing the transport of these holes therethrough. This will convert the electrically inactive polymeric material to a material capable of supporting the injection of photogenerated holes from the generation material and capable of allowing the transport of these holes through the active layer in order to discharge the surface charge on the active layer. An especially preferred transport layer employed in one of the two electrically operative layers in the multilayered photoconductor of this disclosure comprises between about 25 percent and about 75 percent by weight of at least one charge transporting aromatic amine compound, and between about 75 percent and about 25 percent by weight of a polymeric film forming resin in which the aromatic amine is soluble.

The charge transport layer 16 forming mixture preferably comprises an aromatic amine compound. Examples of charge transporting aromatic amines represented by the structural formulae above for charge transport layers capable of supporting the injection of photogenerated holes of a charge generating layer and transporting the holes through the charge transport layer include triphenylmethane, bis(4-diethylamine-2-methylphenyl)phenylmethane; 4'-4"-bis(diethylamino)-2',2"-dimethyltriphenylmethane, N,N'-bis(alkylphenyl)-[1,1'-biphenyl]-4,4'-diamine wherein the alkyl is, for example, methyl, ethyl, propyl, n-butyl, etc., N,N'-diphenyl-N,N'-bis(chlorophenyl)-[1,1'-biphenyl]-4,4'-diamine, N,N'-diphenyl-N,N'-bis(3"-methylphenyl)-(1,1'-biphenyl)-4,4'-diamine, and the like dispersed in an inactive resin binder.

Any suitable inactive thermoplastic resin binder soluble in methylene chloride or other suitable solvent may be employed in the process of this disclosure to form the thermoplastic polymer matrix of the imaging member. Typical inactive resin binders include polycarbonate resin, polyvinylcarbazole, polyester, polyarylate, polyacrylate, polyether, polysulfone, polystyrene, and the like. Molecular weights can vary from about 20,000 to about 150,000.

Any suitable and conventional technique may be utilized to mix and thereafter apply the charge transport layer coating mixture to the charge generating layer. Typical application techniques include spraying, dip coating, roll coating, wire wound rod coating, and the like. Drying of the deposited coating may be effected by any suitable conventional technique such as oven drying, infra red radiation drying, air drying and the like.

Generally, the thickness of the charge transport layer is between about 10 to about 50 micrometers, but thicknesses outside this range can also be used. The hole transport layer should be an insulator to the extent that the electrostatic charge placed on the hole transport layer is not conducted in the absence of illumination at a rate sufficient to prevent formation and retention of an electrostatic latent image thereon. In general, the ratio of the thickness of the hole transport layer to the charge generator layer is preferably maintained from about 2:1 to 200:1 and in some instances as great as 400:1.

The preferred electrically inactive resin materials are polycarbonate resins have a molecular weight from about 20,000 to about 150,000, more preferably from about 50,000 to about 120,000. The materials most preferred as the electrically inactive resin material is poly(4,4'-dipropylidene-diphenylene carbonate) with a molecularweight of from about 35,000 to about 40,000, available as Lexan™ 145 from General Electric Company; poly(4,4'-isopropylidene-diphenylene carbonate) with a molecular weight of from about 40,000 to about 45,000, available as Lexan™ 141 from the General Electric Company; a polycarbonate resin having a molecular weight of from about 50,000 to about 120,000, available as Makrolon™ from Farbenfabricken Bayer A. G. and a polycarbonate resin having a molecular weight of from about 20,000 to about 50,000 available as Merlon™ from Mobay Chemical Company.

Examples of photosensitive members having at least two electrically operative layers include the charge generator layer and diamine containing transport layer members disclosed in U.S. Pat. Nos. 4,265,990, 4,233,384, 4,306,008, 4,299,897and 4,439,507. The disclosures of these patents are incorporated herein in their entirety. The photoreceptors may comprise, for example, a charge generator layer sandwiched between a conductive surface and a charge transport layer as described above or a charge transport layer sandwiched between a conductive surface and a charge generator layer.

If desired, a charge transport layer 16 may only comprise electrically active resin materials instead of or mixtures of inactive resin materials with activating compounds. Electrically active resin materials are well known in the art. Typical electrically active resin materials include, for example, polymeric arylamine compounds and related polymers described in U.S. Pat. Nos. 4,801,517, 4,806,444, 4,818,650, 4,806,443 and 5,030,532 and polyvinylcarbazole and derivatives of Lewis acids described in U.S. Pat. No. 4,302,521. Electrically active polymers also include polysilylenes such as poly(methylphenyl silylene), poly(methylphenyl silylene-co-dimethyl silylene), poly(cyclohexylmethyl silylene), poly(tertiary-butylmethyl silylene), poly(phenylethyl silylene), poly(n-propylmethyl silylene), poly(p-tolylmethyl silylene), poly(cyclotrimethylene silylene), poly(cyclotetramethylene silylene), poly(cyclopentamethylene silylene), poly(di-t-butyl silylene-co-di-methyl silylene), poly(diphenyl silylene-co-phenylmethyl silylene), poly(cyanoethylmethyl silylene) and the like. Vinyl-aromatic polymers such as polyvinyl anthracene, polyacenaphthylene; formaldehyde condensation products with various aromatics such as condensates of formaldehyde and 3-bromopyrene; 2,4,7-trinitrofluoreoene, and 3,6-dinitro-N-t-butylnaphthalimide as described in U.S. Pat. No. 3,972,717. Other polymeric transport materials include poly-1-vinylpyrene, poly-9-vinylanthracene, poly-9-(4-pentenyl)-carbazole, poly-9-(5-hexyl)-carbazole, polymethylene pyrene, poly-1-(pyrenyl)-butadiene, polymers such as alkyl, nitro, amino, halogen, and hydroxy substitute polymers such as poly-3-amino carbazole, 1,3-dibromo-poly-N-vinyl carbazole and 3,6-dibromo-poly-N-vinyl carbazole and numerous other transparent organic polymeric transport materials as Described in U.S. Pat. No. 3,870,516. The disclosures of each of the patents identified above pertaining to binders having charge transport capabilities are incorporated herein by reference in their entirety. A conventional electrically conductive ground strip is also coated along one edge of the web in contact with the conductive layer, blocking layer, adhesive layer or charge generating layer to facilitate connection of the electrically conductive layer of the photoreceptor to ground or to an electrical bias. Ground strip formulations are well known in the art; they are usually comprised of conductive particles dispersed in a film forming binder.

For electrographic imaging members, a flexible dielectric layer overlying the conductive layer may be substituted for the active photoconductive layers. Any suitable, conventional, flexible, electrically insulating, thermoplastic dielectric polymer matrix material may be used in the dielectric layer of the electrographic imaging member.

For typical flexible electrophotographic imaging member or electrographic imaging member belt of the above description, an anti-curl back coating layer 28, applied to the back side of the substrate support, is needed to render the imaging members flatness.

Referring to FIG. 1, a flexible electrophotographic imaging member 10 in the form of a rectangular cut sheet is illustrated having a first edge 12 overlapping a second edge 14 to form an overlap region, as known in the art. Satisfactory overlap widths range from about 0.5 millimeter to about 1.7 millimeters. The flexible electrophotographic imaging member 10 can be utilized in an electrophotographic imaging apparatus and may be a single layer or the illustrated multiple layer type photoreceptor. The layers of the flexible imaging member 10 can comprise numerous suitable materials having the required mechanical properties. These layers usually comprise charge transport layer 16, charge generating layer 18, adhesive layer 20, charge blocking layer 22, electrically conductive layer 24, supporting substrate 26 and anti-curl back coating 28. Examples of the types of layers and the properties thereof are described, for example, in U.S. Pat. Nos. 4,786,570, 4,937,117 and 5,021,309, the disclosures thereof being incorporated herein by reference in their entirety.

Figure 2:
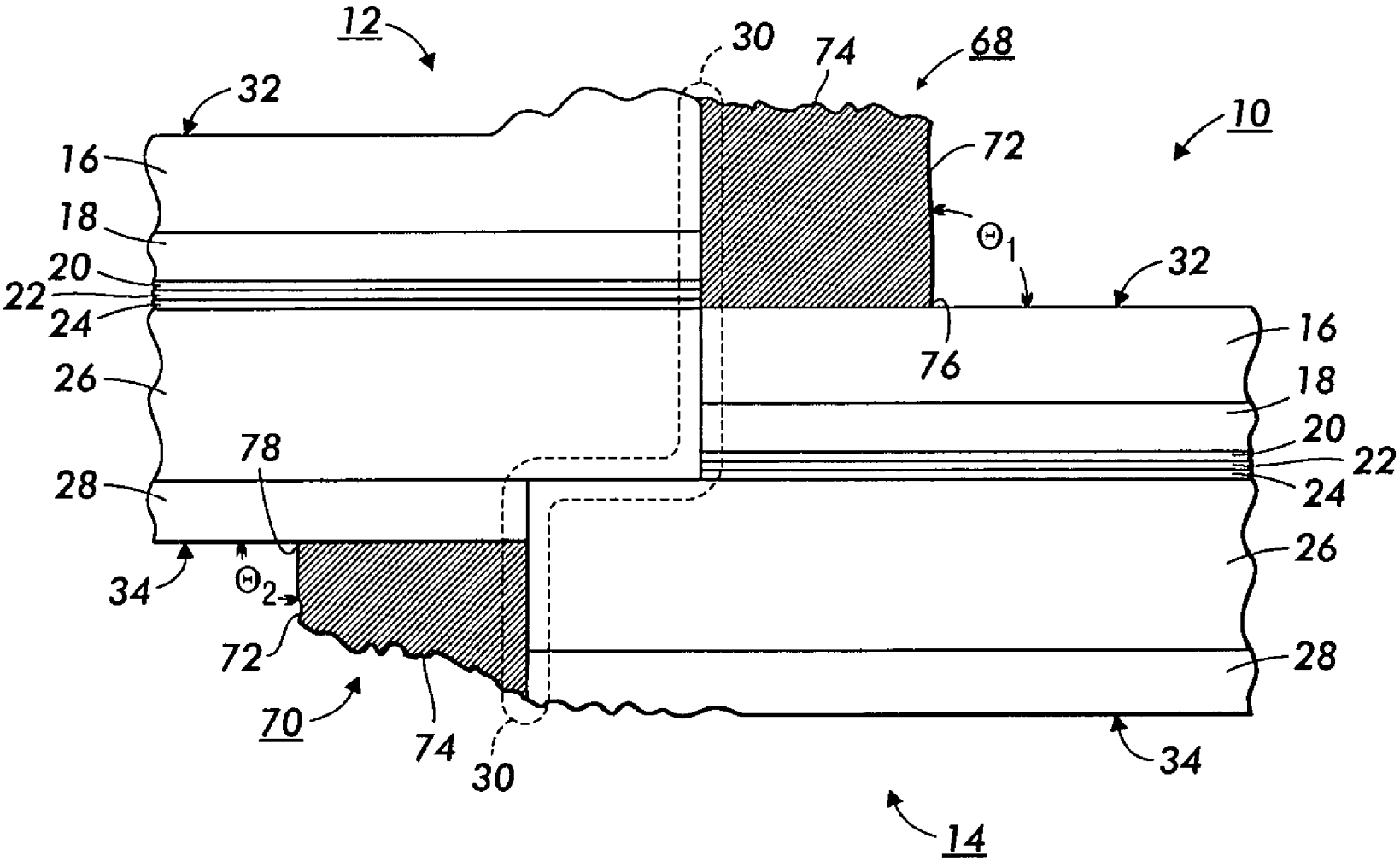
FIG. 2 is a cross sectional view of the flexible multiple layered electrophotographic imaging member ends of FIG. 1 joined by an ultrasonic welding technique to form a seamed belt.

Edges 12 and 14 can be joined by any suitable means. Typical joining techniques include, for example, gluing, taping, stapling, pressure and heat fusing to form a continuous member, such as a belt, sleeve, or cylinder. Generally, an ultrasonic welding technique is preferred to weld edges 12 and 14 into a seam 30 in the overlap region as illustrated in FIG. 2. In the ultrasonic seam welding process, ultrasonic energy is applied to the overlap region to melt the applicable layers of flexible imaging member 10 such as charge transport layer 16, charge generating layer 18, adhesive layer 20, charge blocking layer 22, a part of supporting substrate 26, and anti-curl backing layer. Flexible imaging member 10 is thus transformed from an electrophotographic imaging member sheet 10 as illustrated in FIG. 1 into a continuous seamed flexible electrophotographic imaging belt 10 as shown in FIG. 2. Seam 30 (represented by dashed lines) joins opposite ends of flexible imaging member 10 such that the second major exterior surface 34 (and generally including at least one layer thereabove) at and/or near the first edge 12 is integrally joined with the first major exterior surface 32 (and generally at least one layer therebelow) at and/or near second edge 14. Welded seam 30 contains upper and lower splashings 68 and 70 at ends 12 and 14, respectively, as illustrated in FIG. 2. Splashings 68 and 70 are formed during the process of joining edges 12 and 14 together. Molten material is necessarily ejected from the overlap region to facilitate direct fusing of support substrate 26 (of first edge 12) to support substrate 26 (of second edge 14). This results in the formation of splashings 68 and 70. Upper splashing 68 is formed and positioned above the overlapping second edge 14 abutting second major exterior surface 34 and adjacent and abutting overlapping first edge 12. Lower splashing 70 is formed and positioned below the overlapping first edge 12 abutting first major exterior surface 32 and adjacent and abutting the overlapping second edge 14. Splashings 68 and 70 extend beyond the sides and the ends of seam 30 in the overlap region of welded flexible member 10. The extension of the splashings 68 and 70 beyond the sides and the ends of the seam 30 is undesirable for many machines, such as electrostatographic copiers and duplicators which require precise belt edge positioning of flexible imaging member 10 during machine operation. Generally, the protrusions of the splashings 68 and 70 (or flashings) extending beyond each end (not shown) of the seam usually are removed by a notching operation which cuts a slight notch (not shown) into each end of the seam to remove the end splashings and a tiny portion of the seam itself at both belt edges.

During imaging machine operation, the seamed flexible imaging member belt 10, mounted over a belt support module, cycles and bends/flexes over the belt module support rollers (not shown), particularly the small diameter rollers, of an electrophotographic imaging apparatus causes development of substantial dynamically fatigue induce strain in the belt. As a result of dynamic bending/flexing of the flexible imaging member belt 10 during cyclic function, the small diameter rollers exert a larger bending strain on flexible imaging member belt 10 to cause large stress development compressing from both edges and directed toward the center of the belt. The stress developed to compress the imaging member belt 10 from both belt edges triggers the formation of fatigue induced belt ripples which often time become notable as copy print-out defects. The pre-mature appearance of belt ripples associated copy print-out defects greatly shortens the service life of the flexible imaging member belt 10 and thereby requires frequent costly belt replacement.

Figure 3:
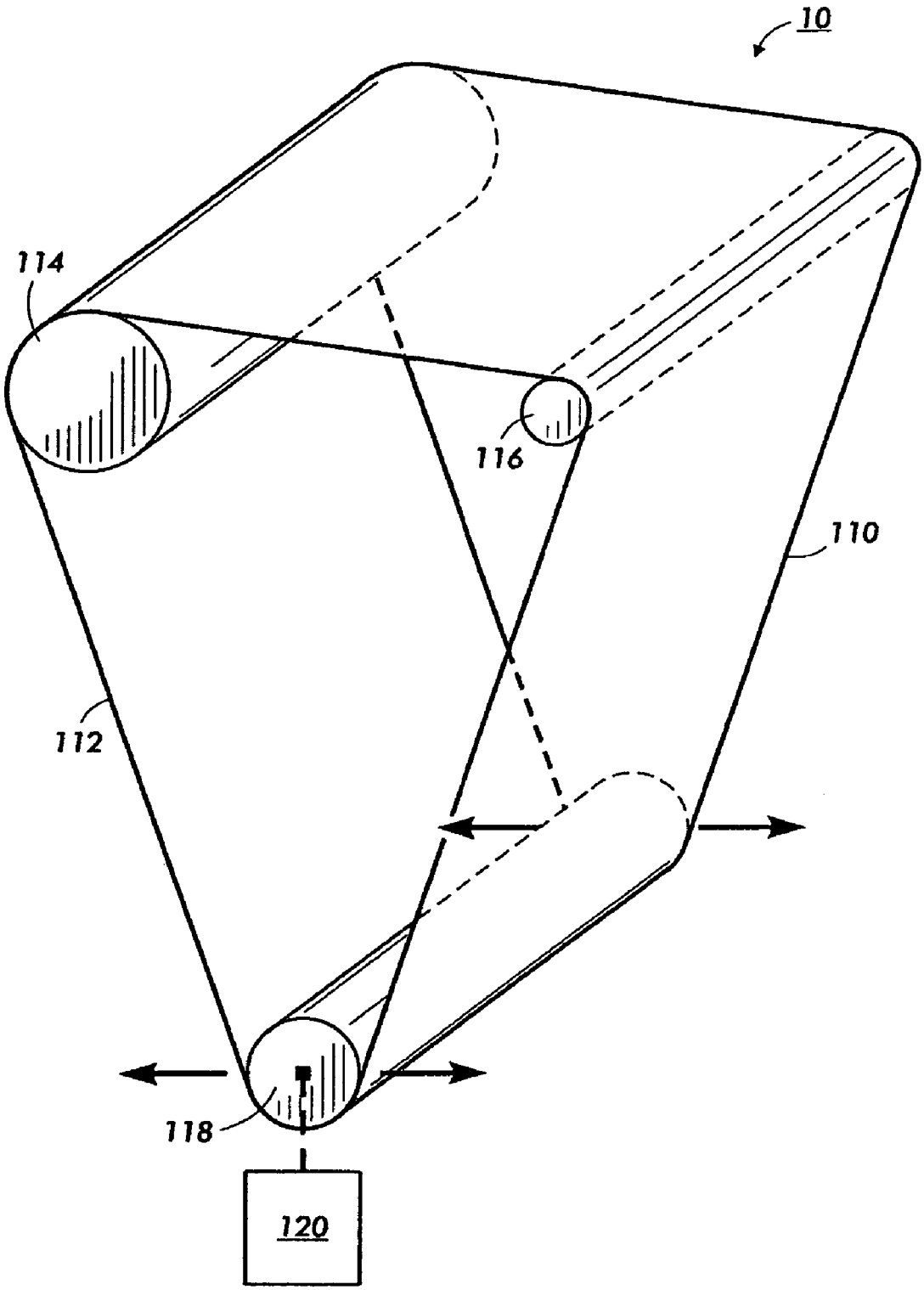
FIG. 3 PRIOR ART
FIG. 3 is a cross sectional view of a seamed electrophotographic imaging member belt of FIG. 2 under dynamic cyclic operating conditions over a belt support module employing an active steering and tension applying roller to control belt walk.

Shown in FIG. 3 is a conventional electrophotographic imaging member belt support module utilized a tri-roller support system in the electrophotographic imaging machines. A flexible electrophotographic imaging belt 10 having two parallel longitudinal edges 110 and 112 is mounted on the belt module to encircle the support rollers 114 and 116 and a center pivoted belt steering and tension applying roller 118. The rollers 114, 116 and 118 are substantially parallel to and spaced from each other. Generally, the largest support roller, i.e. 114, also functions as a drive-roller to drive the belt. The drive-roller is driven by a conventional means such as an electric motor direct drive, gear drive or belt drive to transport belt 10 around rollers 114, 116 and 118. The belt 10 is maintained in a predetermined position on support rollers 114 and 116 relative to the ends of rollers 114 and 116 by conventional steering and tension applying roller 118 which guides the belt 10 by tilting of the axis of roller 118 in the direction shown by the arrows in response to a conventional detector and controller 120. Periodic tilting of belt steering and tension applying roller 118 relative to the support rollers prevents excessive belt walk and maintains the belt on the support rollers during image cycling. As is well known in the art, image cycling includes forming an electrostatic latent image on a belt, developing the electrostatic latent image with toner to form a toner image corresponding to the latent image, transferring the toner image to a receiving member, and repeating the forming, developing and transferring steps at least once. The periodic tilting of belt steering and tension applying roller 118 repeatedly imposes a belt direction tension distribution, which departs from the original uniform applied belt tension, with the lowest value at the longitudinal centerline of belt 10 and gradual increases in intensity which peak at both edges 110 and 112 of belt 10. As a consequence, it is spontaneously creating a transversal cross belt compression strain (as the belt rotates in dynamic motion) distributed in an arcuate gradient of increasing intensity from the longitudinal centerline of the belt to each of the edges of the belt, the strain applied at each of the edges of the belt repeatedly peaking to an intensity at the longitudinal edges of at least about 0.6 percent greater than the strain applied to the centerline of the belt.

Since the tilting of belt steering and tension applying roller 118 repeatedly generates a cross belt compression strain, this compression strain produces rise in fatigue induced belt ripples development in imaging member belt 10. Therefore, the avoidance of ripple formation in belts during dynamic belt cycling in imaging systems utilizing a steering roller can be accomplished through the use of a spreader roller design of the present disclosure according to the pictorial illustration shown in FIG. 4A to replace any one of the belt support rollers shown in FIG. 3.

Figure 8:
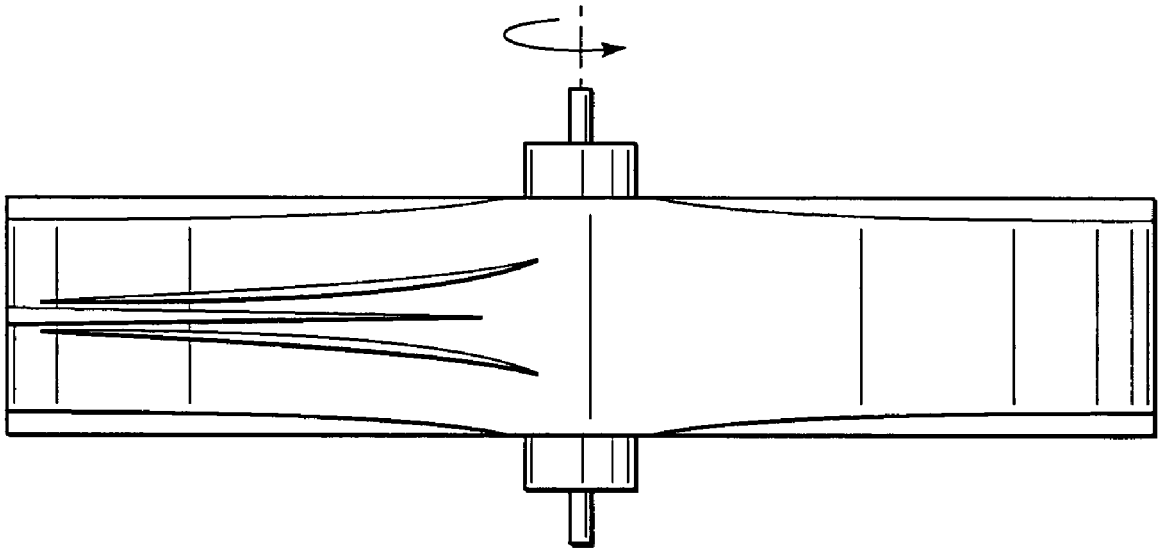
FIG. 8 illustrates the elimination of ripples from the imaging member web produced by embodiments of the present disclosure.

Illustrated in FIG. 4A, including the corresponding enlarged view of a selected portion FIG. 4B, is a flexible spreader roller 400 comprised of a flexible or an elastomeric roller sleeve 410 having a rigid or metal supporting axis 420. The elastomeric outer layer of the flexible spreader roller sleeve 410 has a Shore A hardness ranging from about 20 to about 90 to produce sufficient flexibility for satisfactory function. However, it has been found that a Shore A hardness of about 40 and about 80 provides best performance result. This flexible spreader roller 400 is designed to produce a pattern of specific physical attribute that is capable of creating an outward transversal stretching effect directed from the center toward both longitudinal edges of the imaging member belt each time the segments of the belt are transported over and making contact with the flexible spreader roller 400. This effect is designed to offset the compression strain generated during belt cycling. See, for example, the illustration set forth in FIG. 8.

The elastomeric roller sleeve 410 of the flexible spreader roller 400 is of substantially cylindrical shape. It comprises two series of spiral ribs 430(*a*) and (*b*) and associated channels 440(*a*) and (*b*) on its surface that are wound around the axis of the rotating shaft in diverging directions. In this regard, the spiral ribs consist of a left handed series of ribs 430(*a*) and a right handed series of ribs 430(*b*) interconnected at the center axis of the sleeve by a center boundary 450. The spiral directions of the left and right wound ribs, 430(*a*) and 430(*b*), are opposite one another.

The spiral ribs 430(*a*) and (*b*) are from about 2 mm to about 8 mm in height including from about 4 mm to about 6 mm, and are about 1 mm to about 5 mm in width, including from about 2 mm to about 3 mm. In turn, the associate spiral channels 440(*a*) and (*b*) are from about 1 mm to about 8 mm in depth, including from about 2 mm to about 6 mm, and are from about 0.5 mm to about 4 mm in width, including from about 1 mm to about 2 mm.

Furthermore, as noted in the enlargement set forth in FIG. 4B, the ribs are generally shaped to give a slanted angle of from about 5 to about 40 degrees, including from about 15 to about 25 degrees.

A number of different methods can be utilized to shape and/or form the spiral ribs 430(*a*) and (*b*) and channels 440(*a*) and (*b*) of the elastomer roller sleeve 410. For example, the ribs and channels can be molded from various flexible elastomeric materials such as rubber, synthetic resin, natural rubber, butyl rubber, butadiene-acrylonitrile rubber, polysulfide rubber, neoprene, silicone, polyfluoroethylene such as Viton®, polyurethane, polybutadiene, polystyrene-butadiene, polyethylene-propylene, polychloroprene, polyisobutylene, polyisoprene, and the likes.

The spiral ribs 430 are molded in a manner as to project outwardly in a radial direction on the outer peripheral surface of the sleeve 410. The oppositely directed spiral ribs 430(*a*) and (*b*) are molded in a way that they are joined in the axial center of the sleeve at the center boundary 450.

Alternatively, the ribs 430 can be formed from a solid, substantially cylindrical, elastomeric roller which has been shaped by cutting, grinding, ablation, etc., to remove the channel areas to produce the diverging spiral pattern desired. In this regard, the pattern of the ribs 430 and the channels 440 is designed in such a manner so that the elastomer roller sleeve 410 generates a transverse belt stretching effect to the accompanying belt in a cross web direction or each time the belt is dynamically cycled over and around this belt support spreader roller to neutralize the dynamic motion induced transversal belt compression effect.

The diameter of the flexible spreader roller 400, in embodiments, is from about 0.8 to about 3 inches; preferably about 1 and about 1.5 inches, although other diameters can be used. While it is preferred that the flexible spreader roller 400 replaces either the active steering roller 118 or roller 114 of FIG. 3 to give effectual outcome, nevertheless replacement of roller 114 with the flexible spreader roller 400 is found to produce best result.

Figure 5:
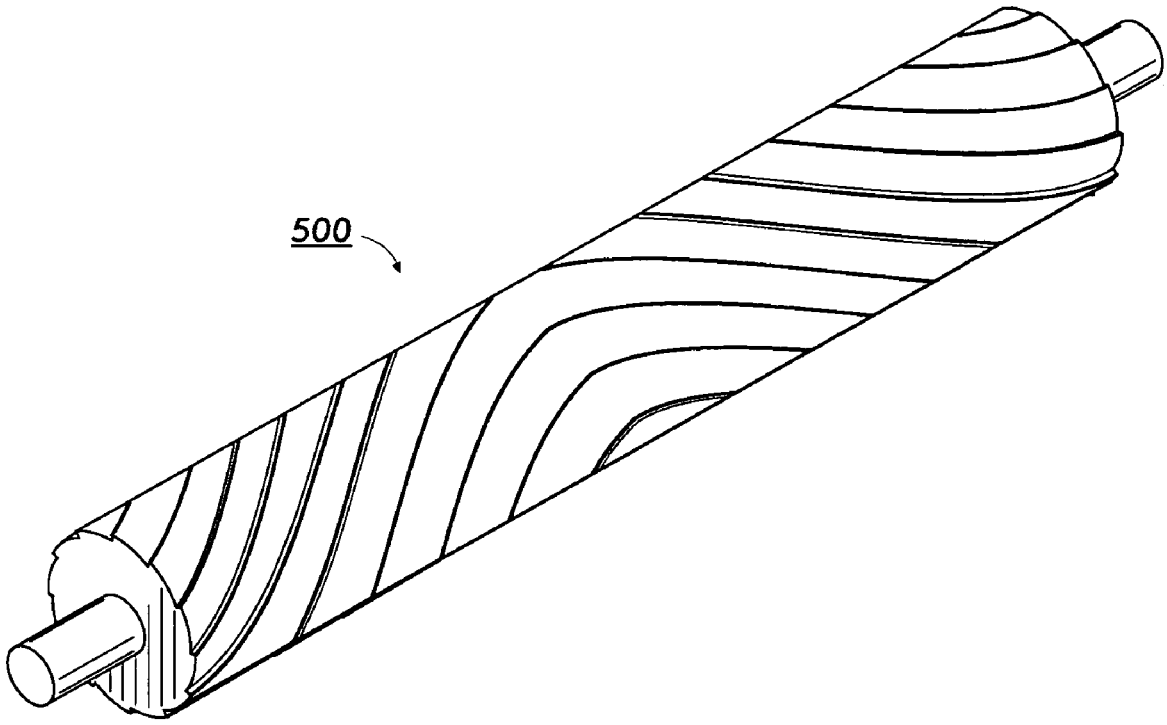
FIG. 5 shows an alternate embodiment of a selected flexible spreader roller.

Additionally, alternative flexible spreader roller embodiments, 500 and 600, illustrated in FIGS. 5 and 6A & B, respectively, are modifications or variances from the embodiment 400 illustrated in FIG. 4A. These embodiments have also been found to be capable of suppressing imaging member belt ripples as well. The diameter of these rollers, in embodiments, is from about 0.8 to about 3 inches to create substantial transversal belt stretching effect.

FIG. 7A illustrates an imaging member belt's ripple topology profile formed after dynamic machine belt cycling to only about 210 revolutions around a belt support module, employing an active steering roller to control belt walk, as that shown in FIG. 3. Additionally, it has also been found that under a typical machine dynamic belt functioning condition, pre-mature spontaneous formation of imaging member belt ripples along the belt direction has often time been noted after just few hundred belt cyclic revolutions around a belt support module even though utilizing no steering roller but having a small 19 mm belt supporting roller to enabling paper self stripping. In a cross-sectional analysis taken transversely of the imaging member belt, these ripples are resemblance to a sine wave of having an average amplitude of about 7 micrometers with a frequency of periodicity of about 6 ripples per inch belt width, and appear to the naked eye as series of fine rings extending around the whole circumference of the imaging member belt. Since the formation of wave like topology of these ripples in the imaging member belt has been found to alter the distance (or gap) between the imaging member belt surface and the machine charging device(s), the ripples thereby affect charge density uniformity on the belt surface; moreover, the wavelike topology of belt ripples does further prevent intimate and uniform contact between a receiving copy sheet and toner images carried on the surface of the belt during toner image transfer step to also adversely impact the quality of the final copy print-out. Since belt ripples developed in the imaging member belt as a result of dynamic belt motion, they do unfortunately manifest themselves into print defects in the receiving copy; therefore, the pre-mature onset of belt ripples degrades the copy quality and cuts short the imaging member belt functioning life.

However, when embodiments of the spreader roller of FIG. 4A are utilized in the very same belt support module, effectual elimination of belt ripples onset is evident, after extended fatigue belt cycling motion to over 15,000 revolutions, as shown in belt topological analysis result presented in FIG. 7B.

This disclosure will further be illustrated in the following, non-limiting examples, it being understood that these examples re intended to be illustrative only and that the disclosure is not intended to be limited to the materials, conditions, process parameters and the like recited therein.

EXAMPLE I

A flexible electrophotographic imaging member web stock, in reference to the illustration in FIG. 1, is prepared by providing a 0.01 μm thick titanium layer 24 coated onto a flexible biaxially oriented Polynaphthalate substrate support layer 26 (Kadalex®, available from ICI Americas, Inc.) having a thermal contraction coefficient of about 1.8×10−5/° C., a glass transition temperature Tg of 130° C., and a thickness of 3.5 mils or 88.7 μm, and applying thereto, by a gravure coating process, a solution containing 10 grams gamma aminopropyltriethoxy silane, 10.1 grams distilled water, 3 grams acetic acid, 684.8 grams of 200 proof denatured alcohol and 200 grams heptane. This layer is then dried at 125° C. in a forced air oven. The resulting blocking layer 22 has an average dry thickness of 0.05 μm measured with an ellipsometer.

An adhesive interface layer is extrusion coated by applying to the blocking layer a wet coating containing 5 percent by weight based on the total weight of the solution of polyester adhesive (Mor-Ester 49,000®, available from Morton International, Inc.) in a 70.30 volume ratio mixture of tetrahydrofuran/cyclohexanone. The resulting adhesive interface layer 20, after passing through an oven, has a dry thickness of 0.095 μm.

The adhesive interface layer 36 is thereafter coated with a photogenerating layer 38. The photogenerating layer dispersion is prepared by introducing 0.45 grams of IUPILON 200® poly(4,4'-diphenyl)-1,1'-cyclohexane carbonate, available from Mitsubishi Gas Chemical Corp and 50 mL of tetrahydrofuran into a glass bottle. To this solution are added 2.4 grams of Hydroxygallium Phthalocyanine and 300 grams of ⅛ inch (3.2 mm) diameter stainless steel shot. This mixture is then placed on a ball mill for 20 to 24 hours. Subsequently, 2.25 grams of poly(4,4'-diphenyl)-1,1'-cyclohexane carbonate is dissolved in 46.1 grams of tetrahydrofuran, then added to this hydrogallium phthalocyanine slurry. This slurry is then placed on a shaker for 10 minutes. The resulting slurry is, thereafter, extrusion coated onto the adhesive interface layer 20 by extrusion application process to form a layer having a wet thickness of 0.25 mm. However, a strip about 10 mm wide along one edge of the substrate web bearing the blocking layer and the adhesive layer is deliberately left uncoated by any of the photogenerating layer material to facilitate adequate electrical contact by the ground strip layer that is applied later. This photogenerating layer is dried at 135° C. for 5 minutes in a forced air oven to form a dry thickness photogenerating layer 18 having a thickness of 0.4 μm layer.

This coated imaging member web is simultaneously co-extrusion overcoated with a charge transport layer 16 and a ground strip layer (not shown in FIG. 1). The charge transport layer is prepared by introducing into an amber glass bottle a weight ratio of 1:1 N,N'-diphenyl-N,N'-bis(3-methylphenyl)-1,1'-biphenyl-4,4'-diamine and Makrolon 5705®, a polycarbonate resin having a weight average molecular weight of about 120,000 commercially available from Farbensabricken Bayer A.G. The resulting mixture is dissolved to give a 15 percent by weight solids in 85 percent by weight methylene chloride. This solution is applied over the photogenerator layer 18 to form a coating which, upon drying, gives a charge transport layer 16 thickness of 29 μm. The resulting dried charge transport layer 18 has a thermal contraction coefficient of 6.5×10 −5/° C., and a glass transition temperature, Tg, of about 85° C.

The approximately 10 mm wide strip of the adhesive layer left uncoated by the photogenerator layer 18 is coated with a ground strip layer during a co-coating process. This ground strip layer (not shown), after drying at 125° C. in an oven and eventual cooling to room ambient, has a dried thickness of about 19 μm. This ground strip is electrically grounded, by conventional means such as a carbon brush contact means during conventional xerographic imaging process. The electrophotographic imaging member web stock, at this point if unrestrained, would spontaneously curl upwardly into a tube due to the thermal contraction mismatch between the charge transport layer 16 and the substrate support layer 26, resulting in greater charge transport layer 16 dimensional shrinkage than the substrate support layer 26 which thereby causing substantial internal stress built-in in the charge transport layer 16. Therefore, an anti-curl back coating 28 is coated to the backside of substrate 26 to render the desired imaging member web stock flatness.

An anti-curl back coating solution is prepared by combining 8.82 grams of polycarbonate resin (Makrolon 5705®, available from BayerAG), 0.72 gram of polyester resin (Vitel PE-200®, available from Goodyear Tire and Rubber Company) and 90.1 grams of methylene chloride in a glass container to form a coating solution containing 8.9 percent by weight solids. The container is covered tightly and placed on a roll mill for about 24 hours until the polycarbonate and polyester are dissolved in the methylene chloride to form the anticurl back coating solution. The anti-curl back coating solution is then applied to the rear surface of the substrate support layer 26 (the side opposite the photogenerator layer and charge transport layer) of the imaging member web stock and dried at 125° C. to produce a dried anti-curl back coating 28 thickness of about 17.5 μm. The resulting electrophotographic imaging member web stock, having the desired flatness and with the same material structure as that schematically illustrated in FIG. 1, is a complete imaging member full device.

MECHANICAL BELT CYCLING TEST

EXAMPLE II

The prepared electrophotographic imaging member web stock of Example I is cut to provide two rectangular sheets, each having the dimensions of 2,808 mm in length and 440 mm in width, for ultrasonic seam welding them into two seamed imaging member belts. Seam welding process is carried out by first overlapping the 2 opposite ends of each rectangular imaging member sheet, to a distance of about one millimeter of one end over the other end, in a manner as that illustrated in FIG. 1, and then joining the overlapped region through application of conventional ultrasonic welding techniques, using 40 KHz sonic energy supplied to a welding horn, to form a seamed imaging member belt similar to the illustration of FIG. 2.

When cyclic tested in a belt support module, employing an active steering/tension roll for belt walk control, as that shown in FIG. 3, the first seamed imaging member belt is noted to develop early onset of ripples formations (see FIG. 7(*a*)) after only approximately 210 belt revolutions; whereas the second seamed imaging member belt dynamically cyclic tested in the exactly same manners, but carried out with the use of an improved belt module design utilizing a 2-inch diameter flexible spreader roller for substitution of belt supporting roller 114 in FIG. 3, does interestingly remain free of belt ripples development after extended 15,000 active belt cyclic revolutions (see FIG. 7 (*b*)).

These dynamically fatigue imaging member belt cycling test results obtained do provide solid indication that the use of a flexible spread roller in the belt support module design can successfully generate a transversal belt tension force adequately enough to counteract the cross belt compression strain, induced by dynamic belt motion. This results in the reduction and/or elimination of belt ripple development and the copy print-out defect problems associated therewith.

While particular embodiments have been described, alternatives, modifications, variations, improvements, and substantial equivalents that are or may be presently unforeseen may arise to applicants or others skilled in the art. Accordingly, the appended claims as filed and as they may be amended are intended to embrace all such alternatives, modifications variations, improvements, and substantial equivalents.

The invention claimed is:

1. An image forming apparatus comprising:

a flexible electrostatographic imaging belt; and, an imaging belt support module, wherein the imaging belt support module comprises one or more rollers for supporting the cycling of the belt and at least one flexible spreader roller to reduce belt ripple development during cycling;

wherein the flexible spreader roller comprises a rigid shaft and a flexible sleeve;

wherein the sleeve has radially projected therefrom, two series of adjacent, but oppositely directed, elastomeric spiral ribs joined at the sleeve's center axis; and wherein the sleeve has two series of adjacent, but oppositely directed, spiral channels associated with the two series of spiral ribs.

2. The image forming apparatus of claim 1, wherein the ribs are comprised of an elastomeric material having a Shore A hardness of from about 20 to about 90.

3. The image forming apparatus of claim 2, wherein the ribs are comprised of an elastomeric material having a Shore A hardness of from about 40 to about 80.

4. The image forming apparatus of claim 1, wherein the ribs project outwardly at a slanting angle of about 5 to about 40 degrees.

5. The image forming apparatus of claim 1, wherein the ribs project outwardly at a slanting angle of about 15 to about 25 degrees.

6. The image forming apparatus of claim 1, wherein the ribs are from about 2 mm to about 8 mm in height.

7. The image forming apparatus of claim 6, wherein the ribs are from about 4 mm to about 6 mm in height.

8. The image forming apparatus of claim 1, wherein the ribs are from about 1 mm to about 5 mm in width.

9. The image forming apparatus of claim 8, wherein the ribs are from about 2 mm to about 3 mm in width.

10. The image forming apparatus of claim 1, wherein the channels are from about 1 mm to about 8 mm in depth.

11. The image forming apparatus of claim 10, wherein the channels are from about 2 mm to about 6 mm in depth.

12. The image forming apparatus of claim 1, wherein the channels are from about 0.5 mm to about 4 mm in width.

13. The image forming apparatus of claim 1, wherein the channels are from about 1 mm to about 2 mm in width.

14. The image forming apparatus of claim 1, wherein the ribs comprise a flexible elastomeric material selected from the group consisting of natural rubber, butyl rubber, butadiene-acrylonitrile rubber, polysulfide rubber, neoprene, silicone, polyurethane, polybutadiene, polystyrene-butadiene, polyethylene-propylene, polychloroprene, polyisobutylene, polyisoprene, polyfluoroethylene, and combinations thereof.

15. The image forming apparatus of claim 1, wherein the diameter of the flexible spreader rolls is from about 0.8 inches to about 3 inches.

16. The image forming apparatus of claim 15, wherein the diameter of the flexible spreader rolls is from about 1 inch to about 1.5 inches.

17. A belt support module for an image forming apparatus comprising at least one flexible spreader roller for suppressing belt ripple development, wherein the flexible spreader roller comprises a metal shaft and an elastomeric sleeve, and wherein the elastomeric sleeve has projected therefrom two series of oppositely directed spiral ribs joined at a central axis.

18. The belt support module of claim 17, wherein the spreader roller is designed to produce an outward transversal stretching effect on a flexible electrostatographic imaging belt used in association with the belt support module.

19. The belt support module of claim 17, wherein the elastomeric sleeve of the flexible spreader roller comprises a plastic having a Shore A hardness of from about 20 to about 90.

* * * * *